US008801490B2

(12) United States Patent
Achan, Jr.

(10) Patent No.: US 8,801,490 B2
(45) **Date of Patent: *Aug. 12, 2014**

(54) SMART STUFFED TOY WITH AIR FLOW VENTILATION SYSTEM

(71) Applicant: LCAIP, LLC, Bellmore, NY (US)

(72) Inventor: Leonard Achan, Jr., Bellmore, NY (US)

(73) Assignee: LCAIP, LLC, Bellmore, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/856,417

(22) Filed: Apr. 3, 2013

(65) Prior Publication Data

US 2013/0225033 A1 Aug. 29, 2013

Related U.S. Application Data

(63) Continuation-in-part of application No. 13/336,839, filed on Dec. 23, 2011, now Pat. No. 8,414,347.

(60) Provisional application No. 61/427,104, filed on Dec. 23, 2010.

(51) Int. Cl.
*A63H 3/00* (2006.01)

(52) U.S. Cl.
USPC ..... 446/72; 446/48; 446/227

(58) Field of Classification Search
USPC ..... 5/423; 297/188.14; 446/72
See application file for complete search history.

(56) References Cited

U.S. PATENT DOCUMENTS

| | | | | |
|---|---|---|---|---|
| 5,317,767 | A * | 6/1994 | Hargest et al. | 5/725 |
| 6,325,084 | B1 * | 12/2001 | Cohen | 135/16 |
| 6,325,085 | B1 * | 12/2001 | Gower | 135/90 |
| 6,843,655 | B1 | 1/2005 | Duprey | |
| 6,887,120 | B2 * | 5/2005 | Shamitoff | 446/99 |
| 7,241,196 | B1 | 7/2007 | Niklibore | |
| 7,360,772 | B2 | 4/2008 | Koch | |
| 7,488,231 | B2 | 2/2009 | Weston | |
| 7,695,063 | B2 * | 4/2010 | Hagler-Gray et al. | 297/188.14 |
| 2002/0094746 | A1 * | 7/2002 | Harlev | 446/178 |
| 2006/0166597 | A1 * | 7/2006 | Dhillon | 446/369 |
| 2006/0234602 | A1 | 10/2006 | Palmquist | |
| 2010/0003888 | A1 | 1/2010 | Massaro | |
| 2010/0093251 | A1 | 4/2010 | Viniotis | |
| 2010/0125949 | A1 * | 5/2010 | Stebbing | 5/423 |

FOREIGN PATENT DOCUMENTS

WO WO 2010/021592 A1 2/2010

* cited by examiner

*Primary Examiner* — Tramar Harper
(74) *Attorney, Agent, or Firm* — IM IP Law PLLC; C. Andrew Im

(57) ABSTRACT

A smart stuffed toy includes a head portion, a torso portion and four limbs. An air flow ventilation device is embedded within the torso portion of the smart stuffed toy to provide air circulation and reduce the settlement of carbon dioxide. The air ventilation device comprises no blades or safe fan blades. Preferably, the front torso surface covering the air flow ventilation device is made of material different from the remaining surfaces of the smart stuffed toy.

20 Claims, 2 Drawing Sheets

SMART STUFFED TOY WITH AIR FLOW VENTILATION SYSTEM

RELATED APPLICATION

This application is a continuation-in-part application of U.S. application Ser. No. 13/336,839 filed Dec. 23, 2011, which claims the benefit of U.S. Provisional Application No. 61/427,104 filed on Dec. 23, 2010, each of which is incorporated herein by reference in its entirety.

TECHNICAL FIELD OF THE INVENTION

The claimed invention relates to a smart stuffed toy that provides air circulation and consoles a child. More particularly, the claimed invention relates to a smart stuffed toy with air circulation or air flow ventilation system that provides critical air circulation within immediate proximity of a sleeping infant or child.

BACKGROUND OF THE INVENTION

When preparing a nursery in a home for a new baby's arrival, typically a fan is not high on the list of necessities. But, recent studies have indicated that an addition of a fan may help prevent sudden infant death syndrome (SIDS), the number one killer of infants from one month to one year old. Researchers believe that fans may help to circulate fresh air and prevent babies from suffocating by re-breathing exhaled carbon dioxide or circulating toxins in the air surrounding a cribs mattress.

However, currently available fans may do more harm than good. Commercially available fans are designed to cool a large area or entire room and use of such fans to circulate fresh air to prevent SIDS may overcool the infant, thereby adversely impacting the baby's health. Moreover, the noise from commercially available fans may disturb the sleeping infant or child. Further, these commercially available fans have sharp fan blades rotating at high speed, so they cannot be located within immediate proximity of the sleeping baby, such as within a baby's crib, because they are too dangerous. These sharp fan blades can potentially cut or injure the baby's limbs, toes and fingers. In summary, these commercially fans are too powerful, too loud and too menacing to a baby, and too dangerous to locate within close proximity of the baby.

Accordingly, the claimed invention proceeds upon a desirability of providing a low volume, low oscillating, safe fan that not only comforts the baby but safely provides air circulation within immediate proximity of the baby without endangering the baby with sharp fan blades that can potentially cut or injure the baby's fingers and toes. Teddy bears and similar stuffed toys have been used to comfort and console infants and children for generations. Nurseries are typically filled with various teddy bears and other stuffed toys. The claimed smart stuffed toy with air flow ventilation system can be located within close proximity of an infant or child, e.g., within a crib, near a car seat, etc., to safely provide critical air circulation within immediate proximity of an infant or child, such as circulating fresh air across a mattress of a crib.

SUMMARY OF THE INVENTION

Therefore, an object of the claimed invention is to provide a smart stuffed toy that provides air circulation or air flow ventilation.

Another object of the claimed invention is to provide the aforesaid smart stuffed toy with a fan comprising no blades or safe fan blades made of soft material.

A still another object of the claimed invention is to provide the aforesaid smart stuffed toy with a carbon monoxide detector or a carbon dioxide detector.

The claimed smart stuffed toy comprises a stuffed toy including a head, limbs and a torso portion. An air circulation or air flow ventilation device, such as a fan having no blades or safe fan blades, is embedded within the torso portion of the smart stuffed toy. The air circulation or air flow ventilation device comprises a battery casing for housing one or more batteries (rechargeable or non-rechargeable) and the battery casing is accessible via a slit formed on a rear surface of the torso portion. In accordance with an aspect of the claimed invention, the air circulation or air flow ventilation device can comprise a micro-controller, fan speed buttons or selection dial, and a timer selection dial, thereby enabling the operator to program fan's speed and duration. In accordance with an exemplary embodiment of the claimed invention, the front torso surface covering the air circulation device, preferably the fan blades, is made of material different from the remaining surfaces of the smart stuffed toy. Preferably, the smart stuff toy is made of hypoallergenic and/or fire-retardant material and the front torso surface is made of foam or air permeable material. The front torso surface can be also made of rubber, plastic or polyvinyl chloride (PVC) with slits/holes or other suitable material to cover the fan or fan blades and provide air flow from the fan embedded within the torso portion of the smart stuffed toy.

Various other objects, advantages, and features of the claimed invention will become readily apparent from the ensuing detailed description, and the novel features will be particularly pointed out in the appended claims.

BRIEF DESCRIPTION OF THE DRAWINGS

The following detailed description, given by way of example, and not intended to limit the claimed invention solely thereto, will best be understood in conjunction with the accompanying drawings in which:

DETAILED DESCRIPTION OF THE EMBODIMENTS

Figure 1:
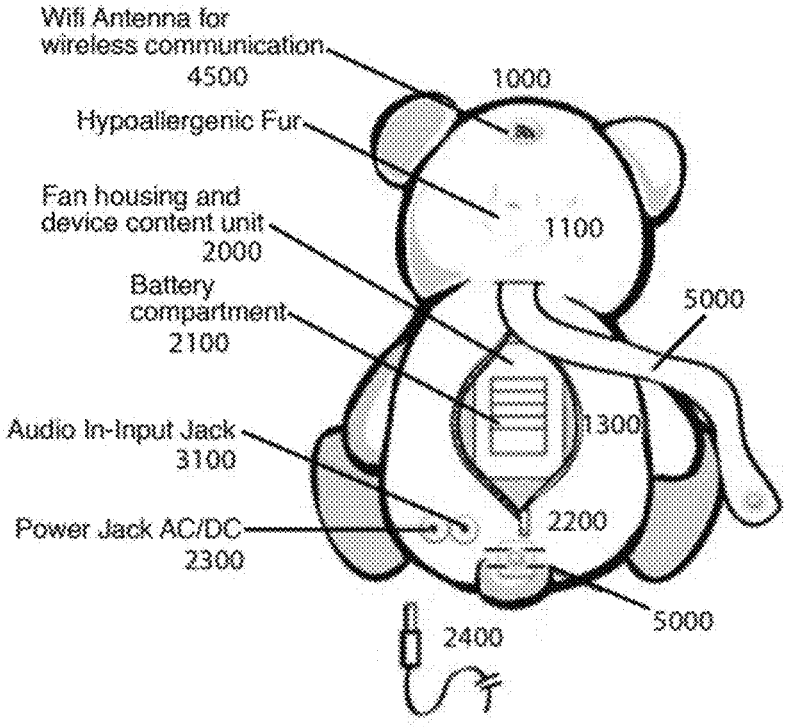
FIG. 1 is a rear, perspective view of the smart stuffed toy in accordance with an exemplary embodiment of the claimed invention.
Figure 2:
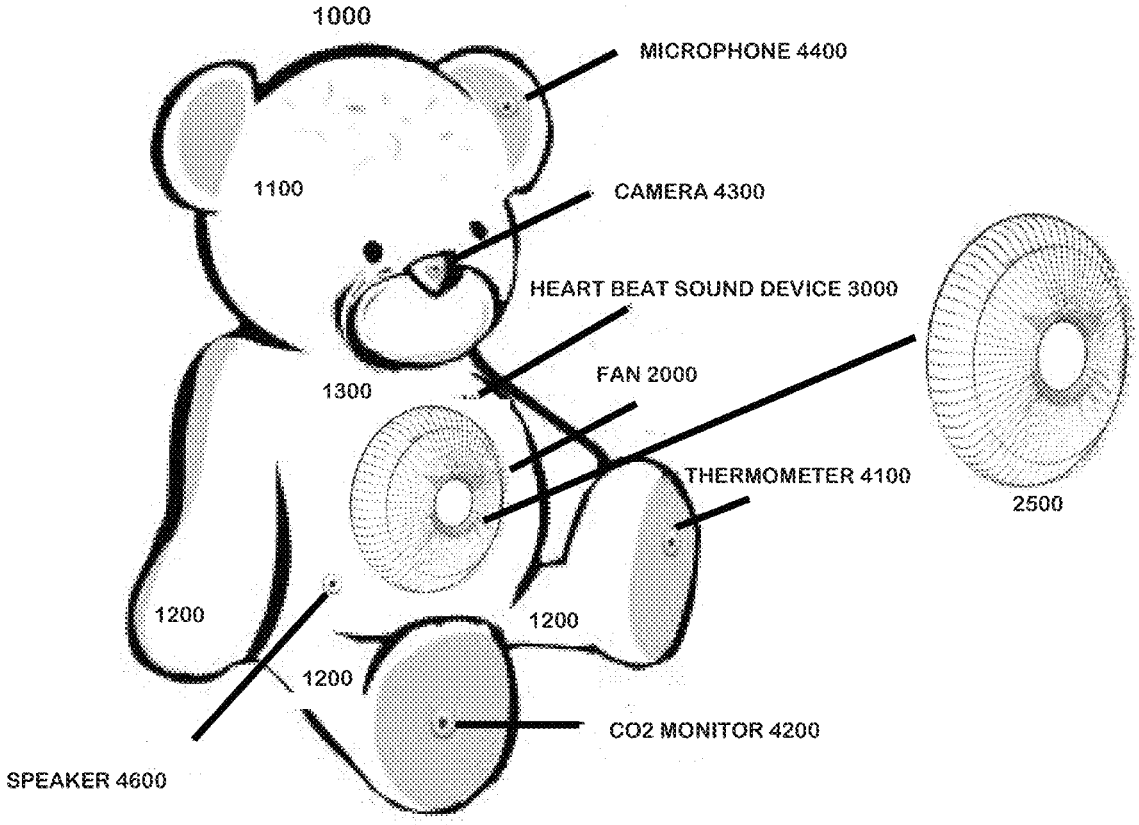
FIG. 2 is a front, perspective view of the smart stuffed toy in accordance with an exemplary embodiment of the claimed invention.

The claimed invention relates to a smart stuffed toy 1000 with air flow ventilation system. The smart stuffed toy 1000 comprises a stuffed toy including a head 1100, limbs 1200 and a torso portion 1300. Preferably, the smart stuffed toy 1000 is made of fire-retardant material. In accordance with an aspect of the claimed invention, the smart stuffed toy 1000 is made of hypoallergenic and fire-retardant material. In accordance with an exemplary embodiment of the claimed invention, embedded within the torso portion 1300 is an air flow ventilation or air circulation system 2000 (i.e., fan housing and device control unit). The air flow ventilation system 2000 comprises soft fan blades 2200 to circulate air within close or immediate proximity of an infant or child, such as in a crib, and reduce settlement of $CO_2$. Preferably, the soft fan blades 2200 is made of foam or other comparable material that will not cut a child's fingers or toes. Preferably, the air flow ventilation system 2000 provides fresh air through the front surface of the torso portion 1300 at low volume and at low oscillating blade speed. The air flow ventilation system 2000 also comprises a battery compartment 2100 accessible via a slit 2200, preferably a zippered slit, formed on a rear surface of the torso portion 1300. The air flow ventilation system 2000 can be powered by plugging the power cord 2400 into a power outlet or with batteries removably housed in the battery compartment 2100. The power cord 2400 can be used to directly power the air flow ventilation system 2000 or recharge the rechargeable batteries in the battery compartment 2100.

In accordance with an exemplary embodiment of the claimed invention, the air flow ventilation system 2000 can operate the safe fan blades 2200 at one speed through a on/off button (not shown) on the surface of the torso portion 1300, preferably on the rear surface of the torso portion 1300. Alternatively, the on/off button can be positioned on the battery compartment 2100. In accordance with an exemplary aspect of the claimed invention, the air flow ventilation system 2000 comprises a micro-controller to operate the air flow ventilation system (e.g., safe fan blades) at multiple speeds (e.g., slow, medium and fast) through speed selector buttons or a speed dial selector. In accordance with another exemplary aspect of the claimed invention, the air flow ventilation system 2000 can comprise an overheating shutoff device to shut off or power down the air flow ventilation device to prevent overheating and/or a timer to control the operational duration of the air flow ventilation system 2000.

In accordance with an exemplary embodiment of the claimed invention, the front torso surface 2500 covering the air circulation device or fan 2000, preferably the fan blades 2200, is made of material different from the remaining surfaces of the smart stuffed toy 1000. Preferably, the smart stuffed toy 1000 is made of fire-retardant material and/or hypoallergenic material. The front torso surface 2500 covering air circulation device or fan 2000 is made of air permeable material, such as foam, to provide air flow from the fan 2000 embedded within the torso portion 1300 of the smart stuffed toy 1000. Alternatively, the front torso surface 2500 can be made of rubber, plastic, polyvinyl chloride (PVC) with slits/holes to provide air flow from the fan 2000 embedded with the torso portion 1300 of the smart stuffed toy 1000.

In accordance with an exemplary embodiment of the claimed invention, the smart stuffed toy 1000 comprises one or more of the following: MP3 player, AM/FM radio or a heart beat sound device 3000, preferably biorhythm maternal heart beat sound machine, to provide a soothing and reassuring sound to the baby. Alternatively, the MP3 player, iPod®, AM/FM radio and other comparable audio devices can be connected to the smart stuffed toy via an audio in-input jack 3100 and the audio sound (e.g., music) can be heard through the speaker 4600. iPod® is a registered trademark of Apple Inc. In accordance with an exemplary aspect of the claimed invention, the smart stuffed toy 1000 comprises a night light (not shown), preferably with a detector that turns the night light on when the level of the light falls below a predetermined threshold.

In accordance with an exemplary embodiment of the claimed invention, the smart stuffed toy 1000 comprises one or more of the following sensors 4000: a digital thermometer or temperature sensor 4100 to measure the temperature, a carbon monoxide and/or $CO_2$ detector 4200 which sounds an alarm if the carbon monoxide and/or $CO_2$ exceeds a predetermined threshold, an audio/video monitoring device comprising a microphone 4400 and a speaker 4600 for two-way communication and/or a video camera 4300, preferably with a pivot and night-vision capability, to provide a video feed. Preferably, the smart stuffed toy 1000 comprises electronic components to support Wi-Fi® and/or Bluetooth® wireless communications 4500. Wi-Fi® is a registered trademark of Wi-Fi Alliance Corporation and Bluetooth® is a registered trademark of Bluetooth Sig, Inc. A remote device (not shown), such as a hand held monitor, a PC, a laptop, a net book, a portable digital assistant (PDA), a tablet, a smart phone and like can communicate with the smart stuffed toy via Internet, Wi-Fi, Bluetooth and other comparable wireless communications. Preferably, the remote device is Wi-Fi and/or Bluetooth enabled. In accordance with an aspect of the claimed invention, the sensors 4000 of the smart stuffed toy 1000 transmits video feed, a carbon monoxide and/or $CO_2$ alarm, audio sound detected by the microphone 4400, temperature reading, motion detector, etc., wirelessly to the remote device, thereby providing a remote monitoring capability.

In accordance with an exemplary aspect of the claimed invention, the microphone 4400 is embedded into one of the ears of the smart stuffed toy, the carbon monoxide and/or $CO_2$ detector is embedded into one of the limbs 1200 (preferably into one of the legs 1200), the digital thermometer 4100 is embedded into another limb 1200 (preferably into the other leg 1200), the speaker 4600 is embedded into the front torso portion 1300, the AC/DC power jack 2300 is embedded into the rear torso portion 1300, the audio in-input jack 3100 is embedded into the rear torso portion 1300, and the heart beat sound device 3000 is embedded into front torso portion 1300.

It is appreciated that the smart stuffed toy 1000 can be a teddy bear, a stuffed dog, a toy, a doll, or any stuffed real or cartoon animal that is made of soft and plush material. Additionally, the smart stuffed toy 1000 comprises a connecting apparatus or straps 5000 for connecting or strapping the smart stuffed toy 1000 onto a rail of the crib, car seat, and the like.

Various omissions, modifications, substitutions and changes in the forms and details of the device illustrated and in its operation can be made by those skilled in the art without departing in any way from the spirit of the present invention. Accordingly, the scope of the invention is not limited to the foregoing specification, but instead is given by the appended claims along with their full range of equivalents.

What is claimed is:

1. A smart stuffed toy, comprising:

a head, limbs, and a torso portion;

an air flow ventilation device embedded within the torso portion for providing air circulation through a front torso surface of the torso portion covering the ventilation device;

wherein the ventilation device reduces settlement of carbon dioxide within immediate proximity of the smart stuffed toy;

wherein the ventilation device is accessible through the torso portion; and wherein the front torso surface covering the ventilation device is made of material different from remaining surfaces of the smart stuffed toy to permit the air to flow from the ventilation device and through the front torso surface.

2. The smart stuffed toy of claim 1, wherein the front torso surface is made of air permeable material.

3. The smart stuffed toy of claim 1, wherein the front torso surface is made of plastic, PVC or rubber with slits or holes to permit air to flow through the front surface.

4. The smart stuffed toy of claim 1, wherein the ventilation device comprises no blades to safely locate the smart stuffed toy within immediate proximity of an infant or child.

5. The smart stuffed toy of claim 1, wherein the ventilation device comprises safe fan blades to safely locate the smart stuffed toy within immediate proximity of an infant or child.

6. The smart stuffed toy of claim 5, further comprising a speaker and a microphone to facilitate two-way communications with the wireless remote device.

7. The smart stuffed toy of claim 1, further comprising a control unit to control and operate the ventilation device at multiple speeds.

8. The smart stuffed toy of claim 1, further comprising an overheating shutoff device to shut off the air flow ventilation device to prevent overheating.

9. The smart stuffed toy of claim 1, further comprising a carbon dioxide detector embedded within one of the limbs for detecting carbon dioxide level and generating an alarm when the detected carbon dioxide level exceeds a predetermined threshold.

10. The smart stuffed toy of claim 1, further comprising a biorhythm maternal heart beat sound device embedded within the torso portion.

11. The smart stuffed toy of claim 1, further comprising a video camera for providing a video feed to a remote device via a wireless communications.

12. The smart stuffed toy of claim 1, further comprising a wireless remote device for providing two-way communications between a remote device and the smart stuffed toy; and wherein the wireless remote device is at least one of the following: a Bluetooth or Wi-Fi enabled device.

13. The smart stuffed toy of claim 12, wherein the wireless remote device is a portable hand held device, a tablet, a smart phone, a personal computer, a laptop or a net book.

14. The smart stuffed toy of claim 12, further comprising a carbon dioxide detector embedded within one of the limbs for detecting carbon dioxide level and transmitting the detected carbon dioxide level to the wireless remote device; and wherein the wireless remote device generates an alarm when the detected carbon dioxide level exceeds a predetermined threshold.

15. The smart stuffed toy of claim 12, further comprising a temperature sensor embedded within one of the limbs for measuring temperature and transmitting measured temperature to the wireless remote device; and wherein the wireless remote device generates an alarm when the measure temperature is outside a predetermined temperature range.

16. The smart stuffed toy of claim 12, wherein the wireless remote device communicates with the smart stuffed toy over the Internet.

17. The smart stuffed toy of claim 1, further comprising a battery compartment embedded within the torso portion to removably house batteries for powering the air flow ventilation device, the battery compartment being accessible through the slit on the rear surface of the torso portion.

18. The smart stuffed toy of claim 1, wherein the ventilation device comprises speed selector buttons or a speed dial selector to operate the ventilation device at multiple speeds.

19. The smart stuffed toy of claim 1, wherein the ventilation device comprises a timer to control operational duration of the ventilation device.

20. The smart stuffed toy of claim 1, further comprising a MP3 player or AM/FM radio embedded within the torso portion.

* * * * *